United States Patent [19]

Blessing

[11] Patent Number: 4,719,654

[45] Date of Patent: Jan. 19, 1988

[54] WALL CONNECTION PIECE FOR A HAND-HELD SHOWER

[75] Inventor: Gerhard Blessing, Villingen, Fed. Rep. of Germany

[73] Assignee: Hans Grohe GmbH & Co. KG, Fed. Rep. of Germany

[21] Appl. No.: 828,638

[22] Filed: Feb. 11, 1986

[30] Foreign Application Priority Data

Feb. 22, 1985 [DE] Fed. Rep. of Germany ..... 3506120

[51] Int. Cl.[4] ..... A47K 3/22

[52] U.S. Cl. ..... 4/597; 4/596; 4/615; 239/282; 239/525; 248/75

[58] Field of Search ..... 4/596, 597, 615, 601; 248/75; 239/525, 282, 587, 588, 310

[56] References Cited

U.S. PATENT DOCUMENTS

| | | | |
|---|---|---|---|
| 2,873,999 | 2/1959 | Webb | 239/282 X |
| 3,826,454 | 7/1974 | Zieger | 248/75 |
| 3,837,013 | 9/1974 | Davis et al. | 248/75 X |
| 3,865,310 | 2/1975 | Elkins et al. | 248/75 X |
| 3,979,096 | 9/1976 | Zieger | 248/75 |
| 4,224,700 | 9/1980 | Bloys | 4/596 |

FOREIGN PATENT DOCUMENTS

| | | | |
|---|---|---|---|
| 1925930 | 10/1965 | Fed. Rep. of Germany | 4/596 |
| 7521122 | 2/1976 | Fed. Rep. of Germany | 4/596 |
| 1904285 | 9/1978 | Fed. Rep. of Germany | 4/596 |

*Primary Examiner*—Henry K. Artis

*Attorney, Agent, or Firm*—Steele, Gould & Fried

[57] ABSTRACT

A wall connecting piece for fitting to a concealed water main and for the connection of a hand-held shower hose contains a casing, which can be connected to the water main and on which is provided a connection for the shower hose. The casing contains a retaining head, which acts on the hand-held shower grip and which is pivotable about an axis passing through the casing.

9 Claims, 8 Drawing Figures

WALL CONNECTION PIECE FOR A HAND-HELD SHOWER

BACKGROUND OF THE INVENTION

The present invention relates to a wall connecting piece with a casing, which is connectable with a wall connection adaptor of a water main and has a connection for a shower hose, as well as with a mounting support for a shower.

In the case of hand-held showers with concealed or flush installation, wall connecting pieces or the like are required for connecting the shower hose to the water mains, as well as in general for providing a holder for said shower. It is already known (German Pat. No. 1,904,285) to provide such a wall connecting piece with a shaped member on which can be hung the shower head. This shaped member is arranged in such a way that the outlet side of the shower head is mounted on the shaped member, so that in this condition it is not possible to operate the hand-held shower. In order to be able to hang up the shower head, it is necessary to have a special construction of the clamping screw or bolt of the shower base.

It is also known to fit mounting supports for hand-held showers independently of a wall connecting piece. In addition, pivotable mounting supports are known.

SUMMARY OF THE INVENTION

The problem of the present invention is to improve a wall connecting piece with a mounting support for a hand-held shower with respect to an improved possibility of functioning and a more universal use.

According to the invention this problem is solved in that the mounting support has a holding or retaining head pivotably mounted in the casing and which acts on the grip region of the hand-held shower. Through holding the retaining head on the grip region, it is possible to use conventional hand-held showers, which need not be specially constructed. In addition, the jet exit surface of the hand-held shower is now free, so that the shower can be used while inserted in the mounting support. This use is further improved by the pivotable mounting support. Through the arrangement of the pivotable retaining head in the casing, it is ensured that all parts are housed in a space saving manner and that no functioning parts are accessible from the outside, which is advantageous particularly in the sanitary field. The retaining head can be constructed in such a way that its parts which may project over the casing surface are rounded, so that there is no risk of the user being injured. Through the engagement of the retaining head on the hand-held shower grip, it is possible to pivot the said head by taking hold of the grip, so that the shower grip simultaneously acts as an actuating member. As a result of the invention, the wall connecting piece and the normally separate mounting support are combined in a subassembly, which avoids the disadvantages of separate mounting supports. According to a further development, the retaining head is pivotable about an axis passing through the casing. Said axis is generally horizontal, but in certain cases can also slope.

It is particularly advantageous if the hand-held shower grip can be locked in the retaining head. To this end, the retaining head can have a slightly conical inner opening, which is accessible from the outside through a slot, so that the shower hose passes through said slot.

According to the invention, the retaining head mounting support can be inserted in the casing, which facilitates manufacture and assembly.

A particularly favourable mounting possibility is provided, if the mounting support has a U-shaped carrier with two approximately parallel arms, between which is inserted the retaining head. This leads to a reliable and well guided mounting of the retaining head. The mounting of the retaining head can e.g. take place through short shaft butts, which engage in recesses in the arms. However, it is particularly advantageous if, according to another feature of the invention, the mounting support has two tubular short hollow shaft butts, which engage in circular grooves in the retaining head.

For absorbing the forces occurring on pivoting the retaining head, advantageously the U-shaped carrier is positively connected or connectable with the casing by means of lateral guides or the like. The guides can e.g. be formed by recesses and corresponding projections.

According to the invention a locking or engaging device can be provided for the retaining head, which makes it possible to lock the latter in several positions, without an additional operating or control element being required. As the retaining head hardly projects from the casing and pivoting can take place with the aid of the inserted hand-held shower, the locking device can be dimensioned in such a way that it effects locking with a relatively large force. Powerful locking can be overcome by acting on the shower, which acts as a lever. According to the invention on the cylindrical inside of at least one hollow shaft butt can be provided locking teeth, with which cooperates a locking element connected in rotationally fixed manner with the retaining head. A locking device of this type can be very easily dimensioned and manufactured, while simultaneously the space requirement for the mounting support is not increased by the locking device. The locking device does not lead to axial forces, so that mounting cannot be impaired by the strong locking device.

According to the invention, the carrier can have two approximately L-shaped and preferably plastic parts. Each L-shaped part has two legs forming the "L", whereof in each case one leg forms an arm and the other leg in superimposed form forms the web of the carrier. At the web, the parts can then be screwed to the casing. The plastic construction makes it possible to shape the hollow shaft butts and optionally the locking teeth in one piece on the legs of the carrier, so that the complete mounting support only consists of a few parts.

According to a further development of the invention the casing is formed from a base element receiving the functioning parts and which can be screwed to a wall, together with a cover fixing the mounting support.

So that the wall connecting piece has limited space requirements, but still does not impair the hose on using the hand-held shower, according to the invention the retaining head and hose connection are arranged in laterally reciprocally displaced manner.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
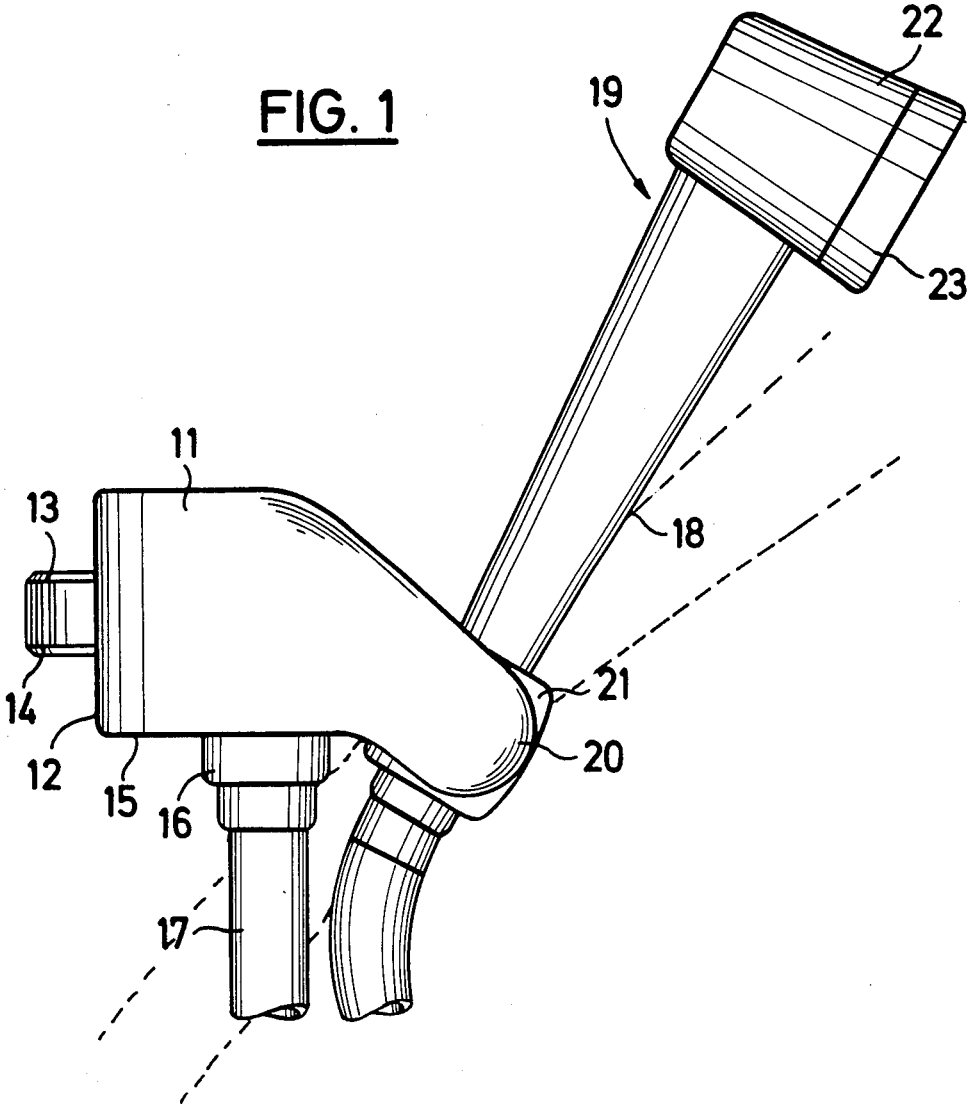
FIG. 1 A side view of a wall connecting piece with inserted shower head proposed by the present invention.

The wall connecting piece shown in FIG. 1 contains a casing 11, which is provided on its back surface 12 with a water connection adaptor 13, which has an external thread 14, by means of which it can be screwed into a water main. A connection 16 for a shower hose 17 is provided on the underside 15 of casing 11, said shower hose leading to the grip 18 of a hand-held shower 19. In the vicinity of its front surface 20, the casing 11 has a retaining head 21 mounted therein, which projects slightly over the outside of casing 11, but is rounded on all sides. Grip 18 of the hand-held shower 19 is fixed in retaining head 21 and specifically in the vicinity of the transition between grip 18 and shower hose 17. It is particularly favourable to hold the retaining head 21 at this point, because e.g. the distance between retaining head 21 and the wall to which casing 11 is to be fixed can be kept small. The shower head 22 of the hand-held shower 19 is arranged in such a way that the jet exit surface 23 is remote from the back surface 12 of casing 11. The hand-held shower 19 can be pivoted about an axis at right angles to the plane of the paper through casing 11 with the aid of the pivotably mounted retaining head 21. Pivoting is brought about in that the user acts on the grip 18 of hand-held shower 19.

Figure 2:
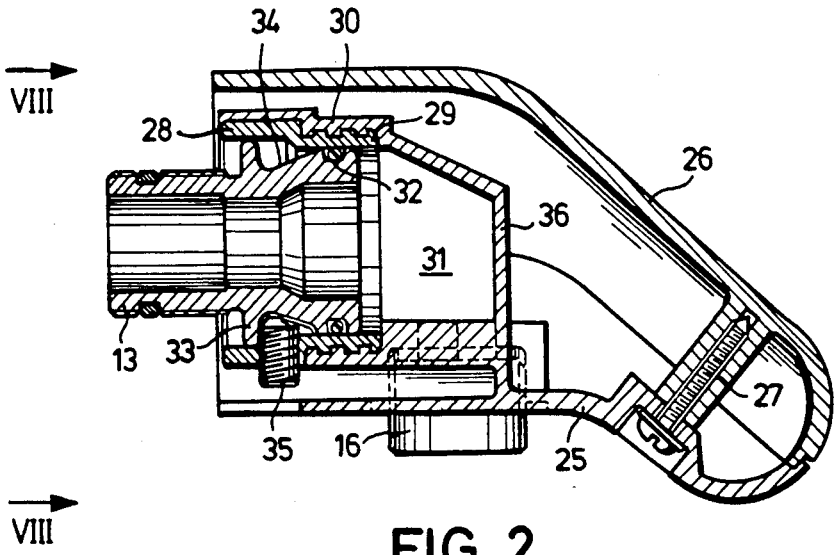
FIG. 2 A section roughly along line II—II in FIG. 3.
Figure 3:
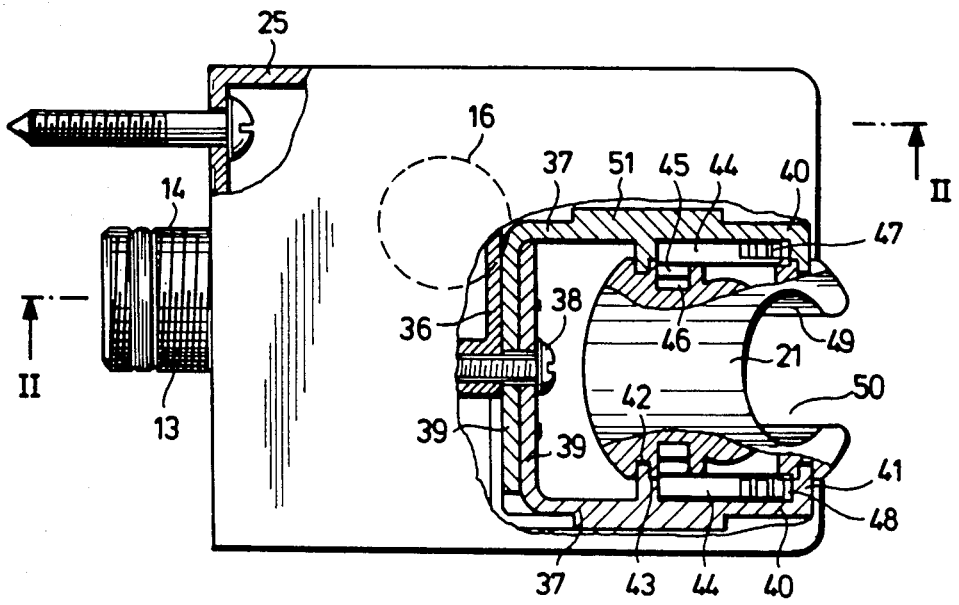
FIG. 3 A partly broken away and sectional view of a wall connecting piece from above in FIG. 2.

As can be gathered from FIG. 2, casing 11 comprises a base member 25, which can be covered by a cover 26, which can e.g. be fixed by a screw 27 to base member 25.

Base member 25 contains a metal pipe socket 28, which has a larger diameter outer area and a smaller diameter inner area 29. The pipe socket 28 is enclosed in a plastic element 30 of base member 25. A passage 31 leads from element 30 to the connection 16 for shower hose 17.

The water connection adaptor is introduced into the pipe socket 28 and between it and said socket 28 a seal 32 is arranged in an annular groove. The water connection adaptor with an all-round rib 33 is supported on the outer area of pipe socket 28. Between rib 33 and seal 32, the water connection adaptor 13 has a conical surface 34, on which acts a grub screw 35 screwed through the pipe socket 28, so that adaptor 13 is fixed relative to socket 28.

Two approximately L-shaped mounting parts 37, each L-shaped part having two connected legs, engage with their leg 39 on partition 36 and are screwed down by means of a screw 38, which passes through the two superimposed legs 39. The in each case other legs 40 of mounting parts 37 contain cylindrical hollow shaft butts 41, whose free edges engage in two corresponding circular grooves 42 in the retaining head 21. Grooves 42 are bounded towards their circle centre by ribs 43, which form a recessed region between them in which is inserted an annular locking member 44. The locking members are held in fixed manner by ribs 43 and in non-rotary manner on retaining head 21 by an eccentric pin 45. Pins 45 engage in holes 46 in retaining head 21.

The locking members 44 have a tooth system 47 preferably comprising 3 teeth, which cooperate with an internal tooth system 48 on the inner walls of the hollow shaft butts 41.

Retaining head 21 contains a slightly conical passage 49 at right angles to the rotation axis and which is open to one side through a slot 50. The shower hose 17 can be introduced through slot 50, so that the hand-held shower 19 can then be extended into the cone until the retaining head 21 secures grip 18 in its transition region to shower hose 17.

The approximately parallel legs 40 of the mounting parts 37 are provided at their particular sides remote from the retaining head 21 with in each case a cross-sectionally rectangular widened portion 51 enabling same to be introduced into a correspondingly shaped recess of the base member 25 of casing 11. In addition to the fixing by screw 38, the two mounting parts 37 are fixed from above by the fitted cover 26.

Figure 4:
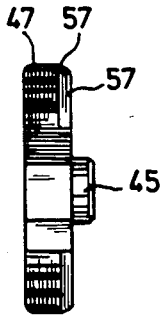
FIG. 4 A side view of a locking element.
Figure 5:
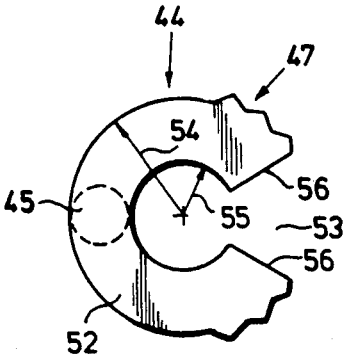
FIG. 5 A plan view of the locking element.

FIGS. 4 and 5 are views of the locking member 44 used. The locking member 44 is formed by a circular ring 52 having a slot 53. The slot extends over an angle of approximately 60°. Circular ring 52 has a relatively large width, i.e. the ratio between its external diameter 54 and its internal diameter 55 is roughly two.

Slot 52 is bounded by two boundary surfaces 56, which are both radially directed. Diametrically facing slot 53, pin 45 serving as a driver is arranged on the rear side of ring 52 as shown in FIG. 5. Tooth system 47 is arranged on either side of slot 53 approximately symmetrically to the angle bisector of bounding surfaces 56 and in the represented preferred embodiment, there are a total of three teeth on either side of slot 52.

As can be gathered from FIG. 4, tooth system 47 does not extend to the side 57 of ring 52 on which is arranged pin 45. The ring 52 has a smooth circumference in this region.

Figure 6:
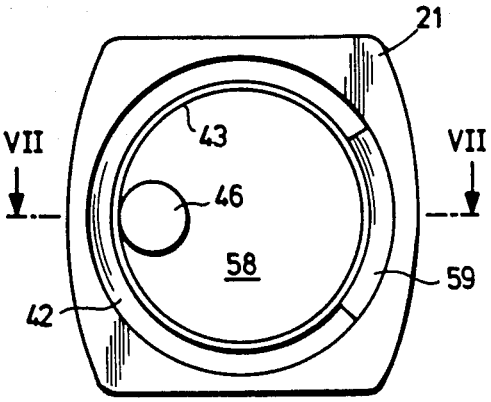
FIG. 6 A side view of a retaining head.

Locking member 44 is intended for the retaining head 21 shown in greater detail in FIG. 6. The retaining head 21 is provided on its sides facing legs 40 with a concentric rib 43, which on its inside forms a shoulder, on which can engage the outer circumference 57 of the untoothed region of ring 52. The height of rib 43 is chosen in such a way that it roughly corresponds to the width of the untoothed outer circumference 57 of ring 52.

In the region 58 of the side of retaining head 21 located within rib 43, it has a recess 46, whose diameter and depth correspond to the diameter and thickness of pin 45. The locking member shown in FIGS. 4 and 5 can therefore be inserted in the space 58 within rib 43, pin 44 engaging in recess 46. Outside rib 43, the sides of retaining head 21 contain an all-round groove 42, whose radial width corresponds to the radial width of the hollow shaft butts 41 of the two legs 40. In its region facing hole 46, groove 42 can contain a depression 59, which can be intended for receiving a curved shoulder on the hollow shaft butts 41. As same only extend over a specific angle, this can lead to a limitation of the pivotability of retaining head 21.

Figure 7:
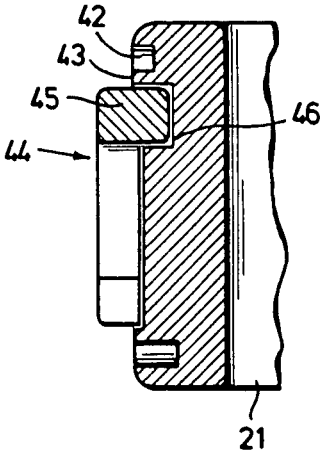
FIG. 7 A section through the retaining head in FIG. 6.

It can be seen in the section of FIG. 7 how the locking member 44 is arranged with its outer circumference between rib 43. Pin 45 engages in hole 46. As a result of the all-sided engagement on the inside of rib 43 and by the insertion of pin 45 in hole 46, a careful driving of the locking member 44 during the rotation of retaining head 21 is obtained.

Figure 8:
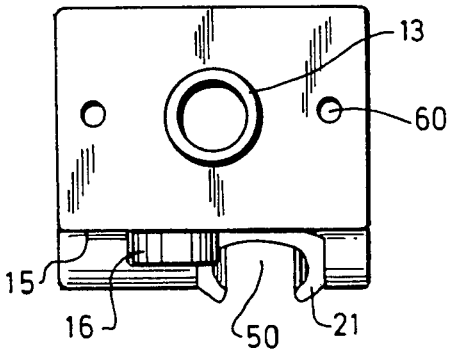
FIG. 8 A view from the rear of the wall connecting piece.

FIG. 8 shows on a smaller scale the wall connecting piece from the wall side, i.e. from the left in FIG. 2. The wall connection adaptor 13 is centrally positioned. On either side of adaptor 13, casing 11 contains two bores 60, through which can pass the screws for fixing casing 11 to the wall. The shower hose connection 16 fitted to the bottom surface 15 of casing 11 is displaced to the left with respect to the centre of casing 11. Retaining head 21 with slot 50 for receiving the hand-held shower is displaced to the other side with respect to the centre of casing 11, i.e. to the right in the represented case. This displacement is sufficient to avoid damage to the shower hose.

What is claimed is:

1. A wall connecting piece, comprising:

a casing which is connectable to a wall connection adaptor for a water main and has a connection for a shower hose leading to a hand-held showing with a grip;

a mounting support for the hand-held shower, the mounting support having a retaining head mounted in the casing and which acts on the grip of the hand-held shower and is pivotable about an axis passing through the casing, the grip being fixable in the retaining head and the retaining head being insertable in the casing, the mounting support for the retaining head having an approximately U-shaped carrier with two approximately parallel arms, between which is inserted the retaining head, the U-shaped carrier having two approximately L-shaped mounting parts, each L-shaped mounting part having two connected legs whereof in each case one leg forms an arm of the carrier and a second leg is superimposed with a corresponding second leg of the other L-shaped mounting part to form a connecting web between the arms of the U-shaped carrier.

2. A wall connecting piece according to claim 1, wherein the U-shaped carrier is positively connected to the casing via lateral guides.

3. A wall connecting piece according to claim 1, wherein the mounting support has two tubular short hollow shaft butts, which engage in circular grooves in the retaining head.

4. A wall connecting piece according to claim 1, wherein a locking device is provided for the retaining head.

5. A wall connecting piece, comprising:

a casing which is connectable to a wall connection adaptor for a water main and has a connection for a shower hose leading to hand-held shower with a grip;

a mounting support for the hand-held shower, the mounting support having a retaining head mounted in the casing and which acts on the grip of the hand-held shower and is pivotable about an axis passing through the casing, the grip being fixable in the retaining head, the mounting support having two tubular short hollow shaft butts, which engage in circular grooves in the retaining head, and a locking tooth system being arranged on an internal cylindrical surface of at least one of said hollow shaft butts and a locking member being connected in rotationally fixed manner with the retaining head, the locking member engaging in the locking tooth system to movably orient the grip.

6. A wall connecting piece according to claim 3, wherein the hollow shaft butts are shaped in one piece on the carrier legs.

7. A wall connecting piece according to claim 1, wherein the casing is formed from a base member receiving functioning parts and which can be screwed to a wall and a cover fixing the mounting support.

8. A wall connecting piece according to claim 1, wherein the retaining head and the hose connection are arranged in a reciprocally, laterally displaced manner.

9. A wall connecting piece according to claim 1, wherein the L-shaped mounting parts are plastic.

* * * * *